US011300037B1

(12) United States Patent
Buzinov et al.

(10) Patent No.: US 11,300,037 B1
(45) Date of Patent: Apr. 12, 2022

(54) COOLANT PUMP MODULE

(71) Applicant: Deere & Company, Moline, IL (US)

(72) Inventors: Andrey Y. Buzinov, Westmont, IL (US); Brian M. Schmidt, Janesville, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/070,122

(22) Filed: Oct. 14, 2020

(51) Int. Cl.
*F01P 5/10* (2006.01)
*F01P 7/16* (2006.01)
*F01P 3/12* (2006.01)

(52) U.S. Cl.
CPC ..... *F01P 7/16* (2013.01); *F01P 3/12* (2013.01); *F01P 5/10* (2013.01); *F01P 2025/30* (2013.01)

(58) Field of Classification Search
CPC ..... F01P 5/10
See application file for complete search history.

(56) References Cited

U.S. PATENT DOCUMENTS

| | | | | |
|---|---|---|---|---|
| 4,741,293 | A * | 5/1988 | Itoh | F01P 7/16 123/41.79 |
| 2017/0114700 | A1* | 4/2017 | Maki | F01P 3/02 |
| 2019/0112965 | A1* | 4/2019 | Lee | F01P 7/165 |
| 2019/0186339 | A1* | 6/2019 | Lee | F04D 29/586 |
| 2020/0263597 | A1* | 8/2020 | Lee | F01P 7/16 |
| 2020/0300156 | A1* | 9/2020 | Muto | F01P 7/167 |

FOREIGN PATENT DOCUMENTS

| | | |
|---|---|---|
| IN | 201643031620 | 3/2008 |
| IN | 257593 | 10/2013 |
| JP | 2004132180 A | 5/2008 |

* cited by examiner

*Primary Examiner* — Long T Tran
(74) *Attorney, Agent, or Firm* — Tucker Ellis LLP

(57) ABSTRACT

A coolant pump module for an internal combustion engine is provided. The coolant pump module includes an inlet thermostat and an exhaust gas recirculation (EGR) passage integrated into a single unit. The coolant pump module provides inlet and outlet of coolant to various cooling circuits and inlet and outlet for an EGR gas circuit.

19 Claims, 8 Drawing Sheets

COOLANT PUMP MODULE

BACKGROUND

Internal combustion engines are often cooled through circulation of an engine coolant through an engine block, where the coolant absorbs heat from the engine. The coolant can subsequently be circulated through a radiator to dissipate the absorbed heat to the environment before being circulated again through the engine block. A coolant pump associated with the engine drives the coolant through the circuit. The circuit may also include a thermostat configured to restrict flow to the radiator until the coolant reaches a predetermined temperature.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation, a coolant pump module for an engine is provided. The coolant pump module includes a module housing having a set of integrated passages. The set of integrated passages include at least a first passage for fluid flow from a radiator, a second passage for fluid flow from the engine, and a third passage for fluid flow to the engine. The coolant pump module also includes a thermostat coupled to the module housing in proximity to the first passage and the second passage. In addition, the coolant pump module further includes a pump mounted to the module housing for moving a coolant through a cooling circuit of the engine.

In another implementation, a method controlling a coolant flow through a cooling circuit of an engine is provided. The method includes receiving a first and second coolant flow from the engine and a radiator, respectively, at coolant pump module coupled to the cooling circuit. The method also includes combining the first and second coolant flow via operation of a thermostat integrated with the coolant pump module. In an example, the thermostat is responsive to a temperature of the coolant at the coolant pump module. Further, the method can include outputting a third coolant flow to engine after the combining via a pump integrated with the coolant pump module.

In still another implementation, a module is provided that includes a monolithic unit providing a plurality of fluid passages. The plurality of passages include at least a radiator passage, a bypass passage, a coolant output passage, and a pump inlet passage. The module further includes a pump coupled to the monolithic unit. A pump inlet is in fluid communication with the pump inlet passage and a pump outlet is in fluid communication with the coolant output passage. The module also includes a thermostat coupled to the monolithic unit proximate to the radiator passage and the bypass passage. The thermostat is configured to regulate a coolant flow into the coolant pump module from the radiator passage in accordance with a fluid temperature.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

Various non-limiting embodiments are further described in the detailed description given below with reference to the accompanying drawings, which are incorporated in and constitute a part of the specification.

DETAILED DESCRIPTION

Figure 1:
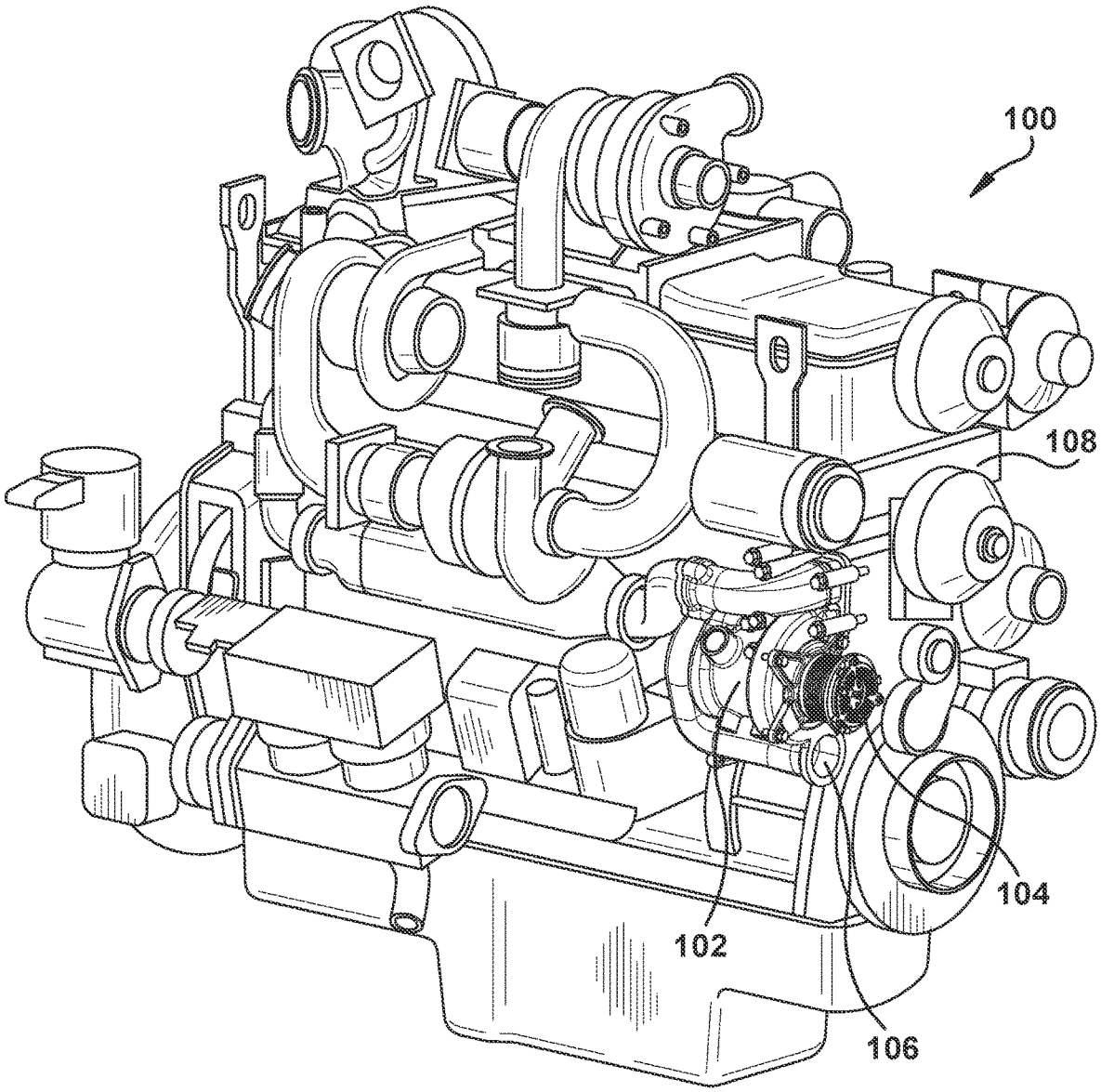
FIG. 1 illustrates an exemplary, non-limiting embodiment of an internal combustion engine according to various aspects.

As described above, a typical internal combustion engine may include a coolant pump to circulate a fluid (e.g. an engine coolant) through a fluid circuit that includes an engine block and/or a radiator. In some configurations, the coolant may circulate through the engine block more than once before passing through the radiator to exchange absorbed heat with the environment. To control this bypass of the radiator, a thermostat can be positioned on the fluid circuit. Conventionally, the thermostat is located at an engine coolant outlet and measures a temperature of the coolant after the coolant passes through the engine.

In accordance with various embodiments, a coolant pump module for an internal combustion engine is provided. The coolant pump module includes an inlet thermostat and an exhaust gas recirculation (EGR) passage integrated into a single unit. Thus, the coolant pump module provides inlet and outlet of coolant to various cooling circuits and inlet and outlet for an EGR gas circuit. Coolant flow and gas flow in the module are through separate internal passages. The coolant pump module, in one aspect, is constructed of light weight material.

With this module, coolant from a radiator, for example, is circulated to an engine with a pump integrated with the module. In one aspect, the thermostat is positioned upstream of the pump at the inlet of the module for coolant. The thermostat may be dimensioned to provide a sufficient cross-sectional area to reduce a pressure drop and reduce a pump cavitation risk. In addition, placement at the inlet allows coolant flow from the engine (e.g. via a bypass) to mix with coolant flow from the radiator to be mixed near the thermostat, which facilitates maintaining a consistent coolant flow temperature to the engine. The consistent coolant flow temperature helps minimize a possibility of thermal shock, reduces system pressure, and reduces temperature cycling.

According to a further aspect, the coolant pump module accommodates coolant return from other engine components and/or a surge tank. Such coolant may flow to a pump inlet via a mixing chamber. The mixing chamber, in an embodiment, reduces coolant flow turbulence in the pump inlet passage.

During operation, coolant enters through a passage of the module coupled to an engine block. If a temperature of the coolant is less than a predetermined temperature (e.g. a start-to-open temperature) configured for the thermostat, the coolant flows through the passages in the module to coolant pump and back to the engine. If the temperature of the coolant is greater than the predetermined temperature, the coolant flow to the radiator for cooling and returns to the module (and, subsequently, the pump) after cooling.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Referring briefly to FIG. 1, an exemplary, non-limiting embodiment of an internal combustion engine 100 is illustrated. As shown in FIG. 1, a portion of a cooling circuit is depicted. In particular, FIG. 1 shows engine 100 with a coolant pump module 102. The coolant pump module 102 includes a pump cartridge 104 and a module inlet 106. The module inlet receives a coolant flow from a radiator (not shown). The engine 100 includes a coolant outlet 108 providing coolant flow to a surge tank (not shown) and/or the radiator after passing through engine 100.

Turning now to FIGS. 2-8, an exemplary, non-limiting embodiment of coolant pump module 102 (also referred to herein as module 102) is illustrated in accordance with various aspects. Module 102 includes a housing 220, which may be a monolithic unit composed of a lightweight material. Module 102 further includes a pump cartridge 202 and a thermostat 204, which may be mounted to or integrated with housing 220. According to an embodiment, pump cartridge 202 may be a pump having a two-speed electromagnetic clutch. Further, thermostat 204 may be a wax motor configured according to a predetermined temperature, referred to as a start-to-open temperature. Thus, in one example, thermostat 204 remains closed until a temperature reaches the predetermined temperature (e.g. predetermined temperature), which may be a fluid temperature of a coolant at an inlet of module 102.

Figure 2:
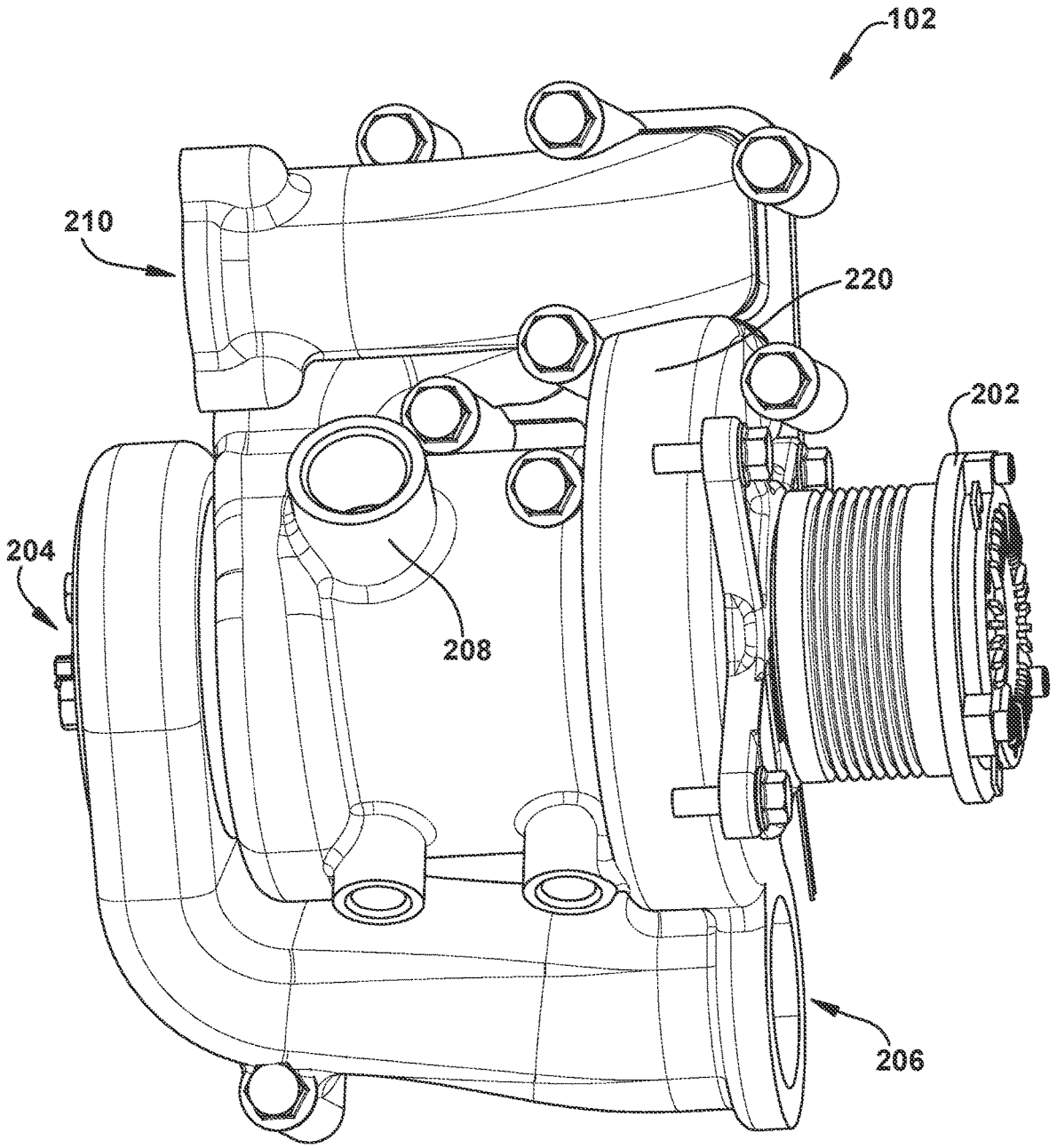
FIG. 2 illustrates a front-right perspective view an exemplary, non-limiting embodiment of a coolant pump module according to various aspects.
Figure 3:
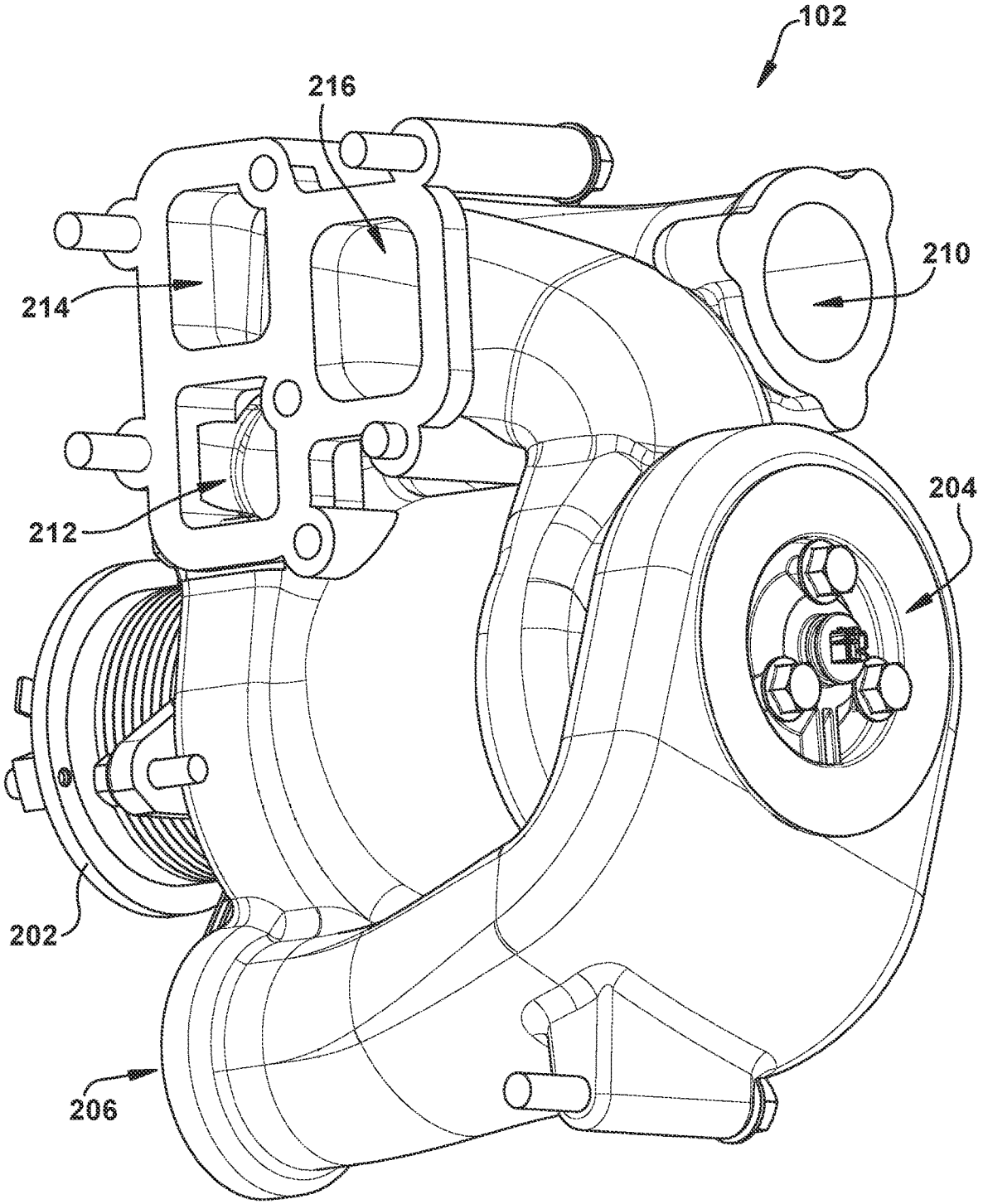
FIG. 3 illustrates a back-left perspective view of the coolant pump module.
Figure 4:
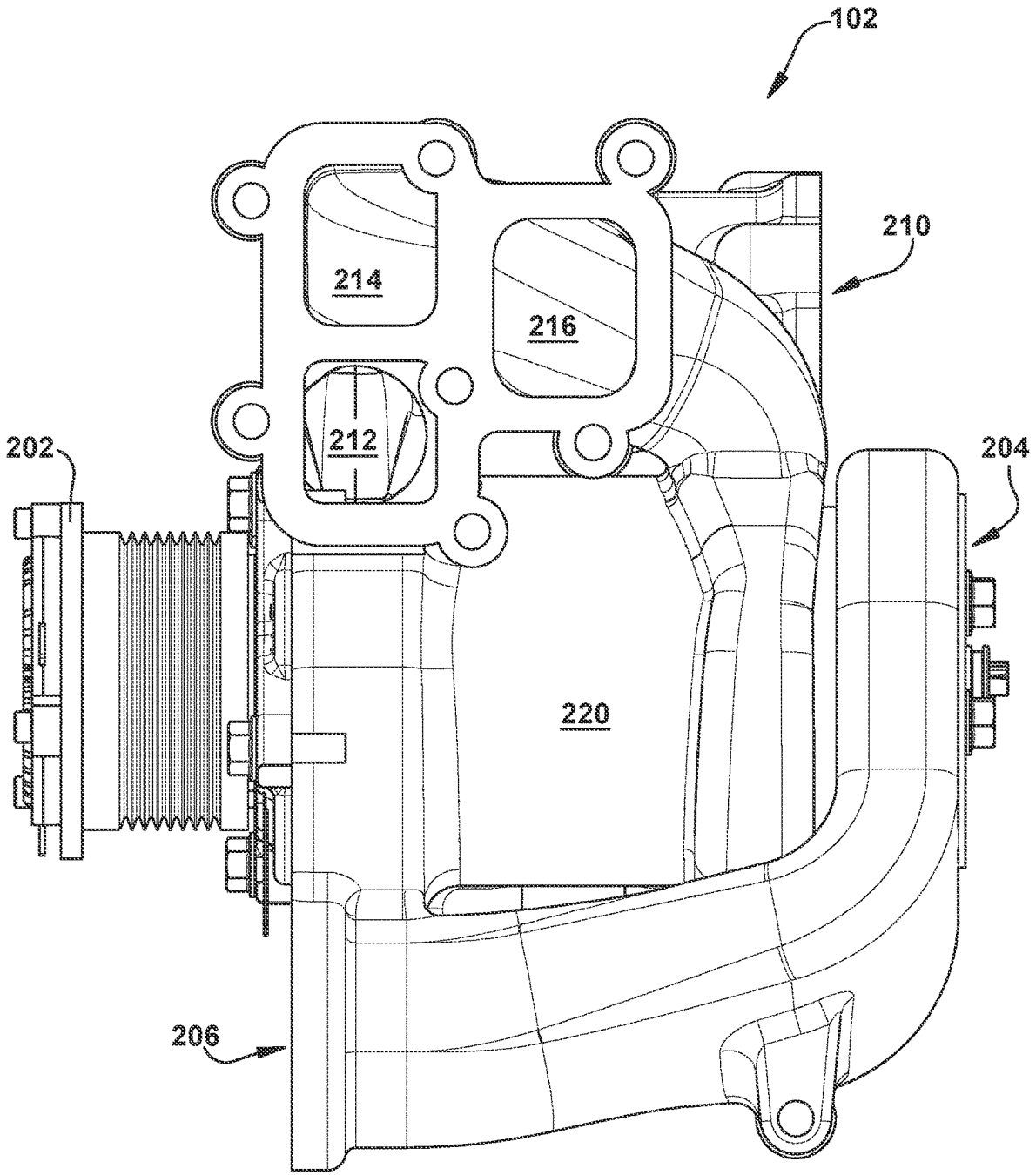
FIG. 4 illustrates a back view of the coolant pump module.
Figure 5:
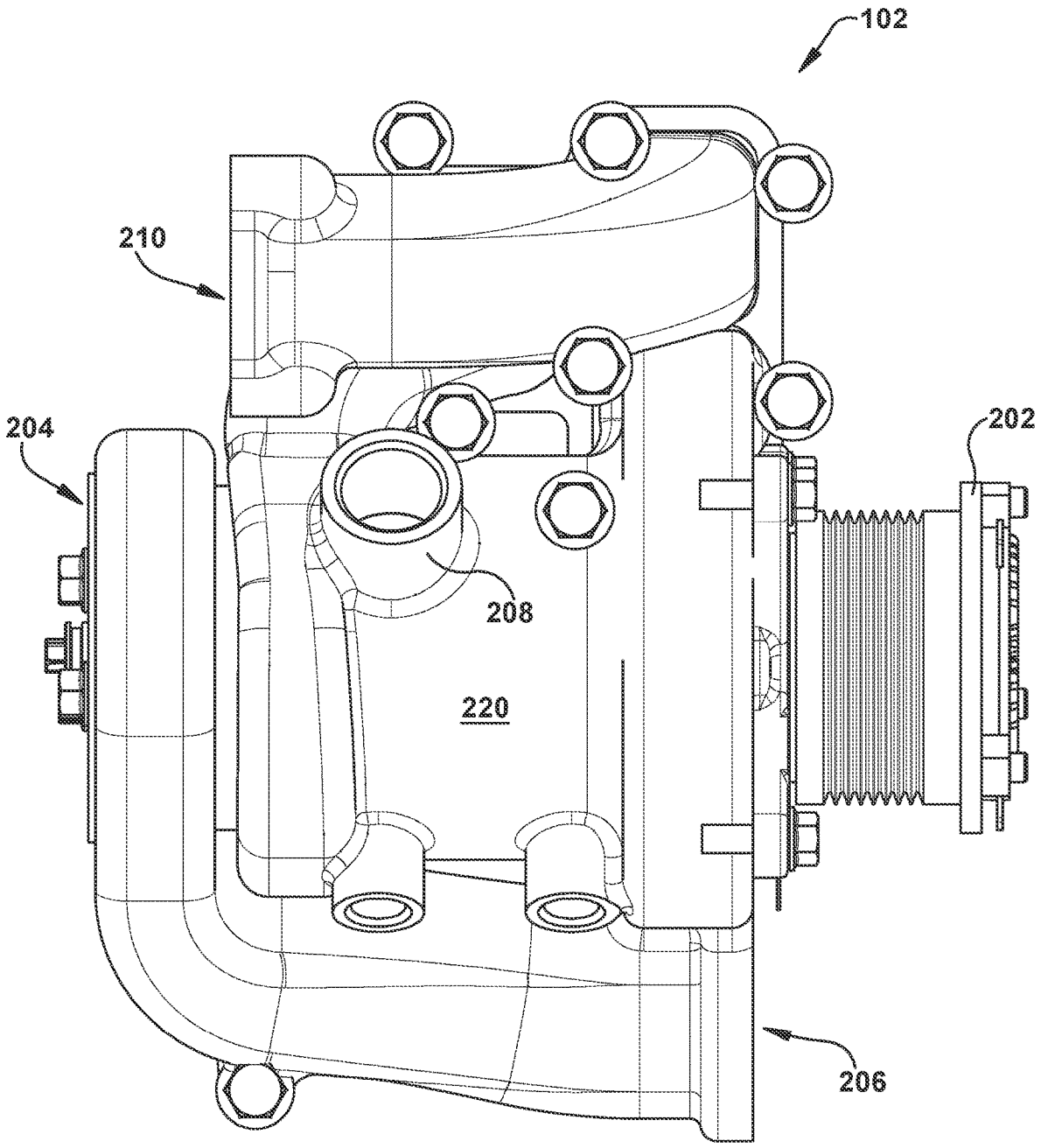
FIG. 5 illustrates a front view of the coolant pump module.
Figure 6:
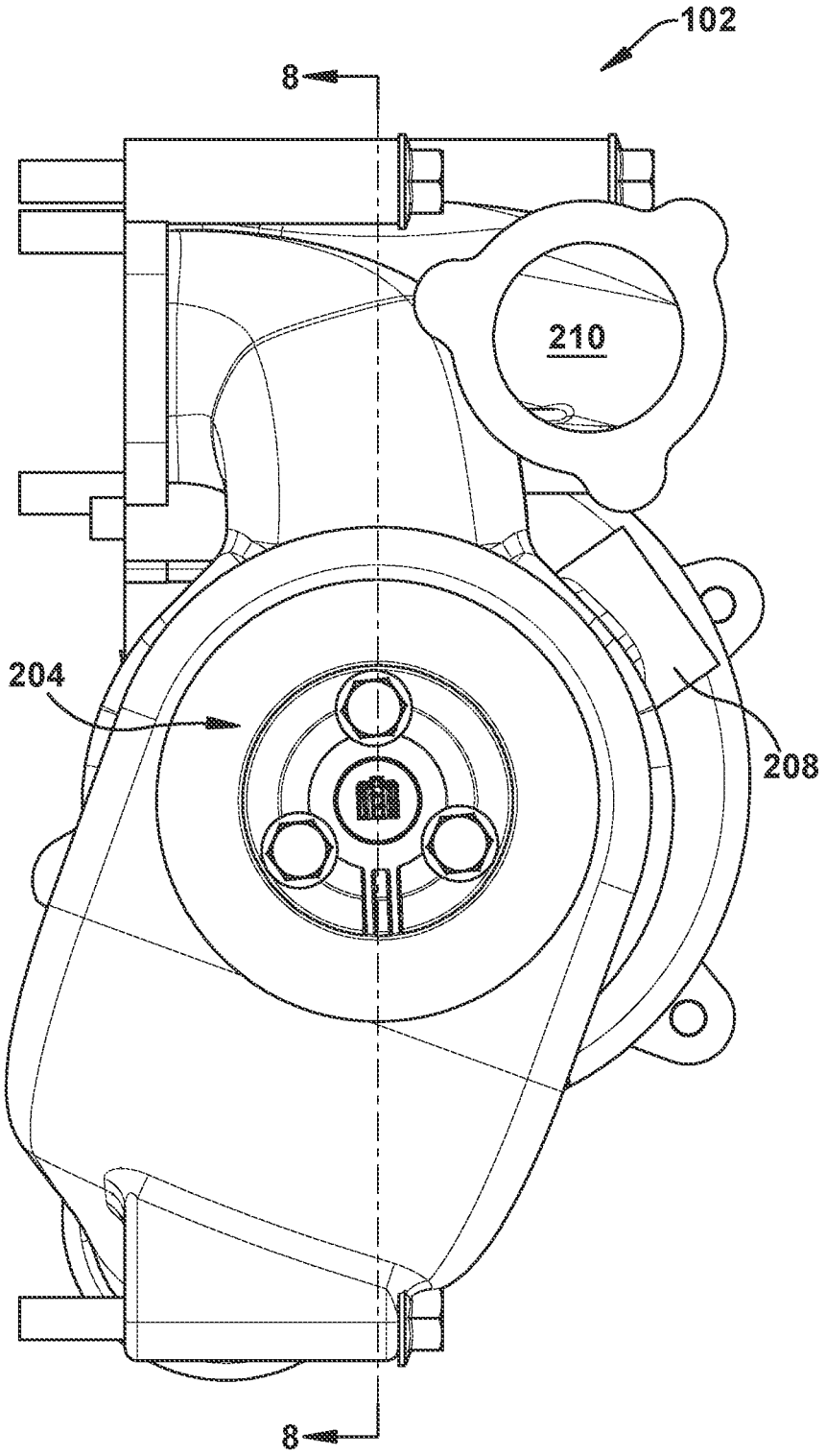
FIG. 6 illustrates a left view of the coolant pump module.
Figure 7:
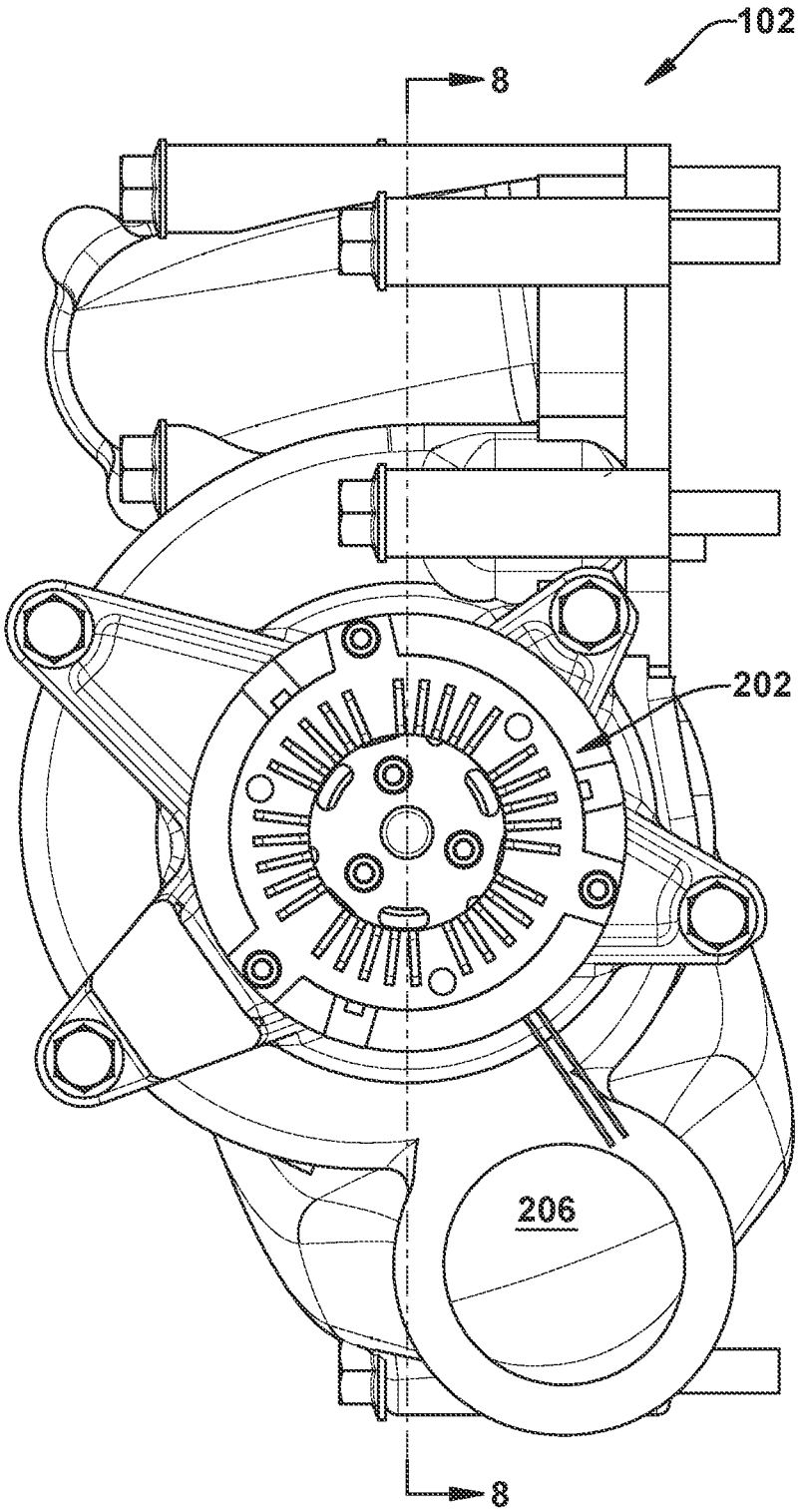
FIG. 7 illustrates a right view of the coolant pump module.

Module 102 includes a plurality of inlets and outlets. These include, for example, a radiator inlet 206 that receives flow from the radiator, a surge tank port 208 that receives a return flow from a surge tank, and an exhaust gas recirculation (EGR) inlet 210 as shown in FIGS. 2, 6 and 7; and, as best shown in FIGS. 3 and 4, a module outlet 212 from which an output of pump 202 flows, an EGR outlet 214, and an engine return inlet 216 that receives a return flow of coolant after circulating through the engine.

Figure 8:
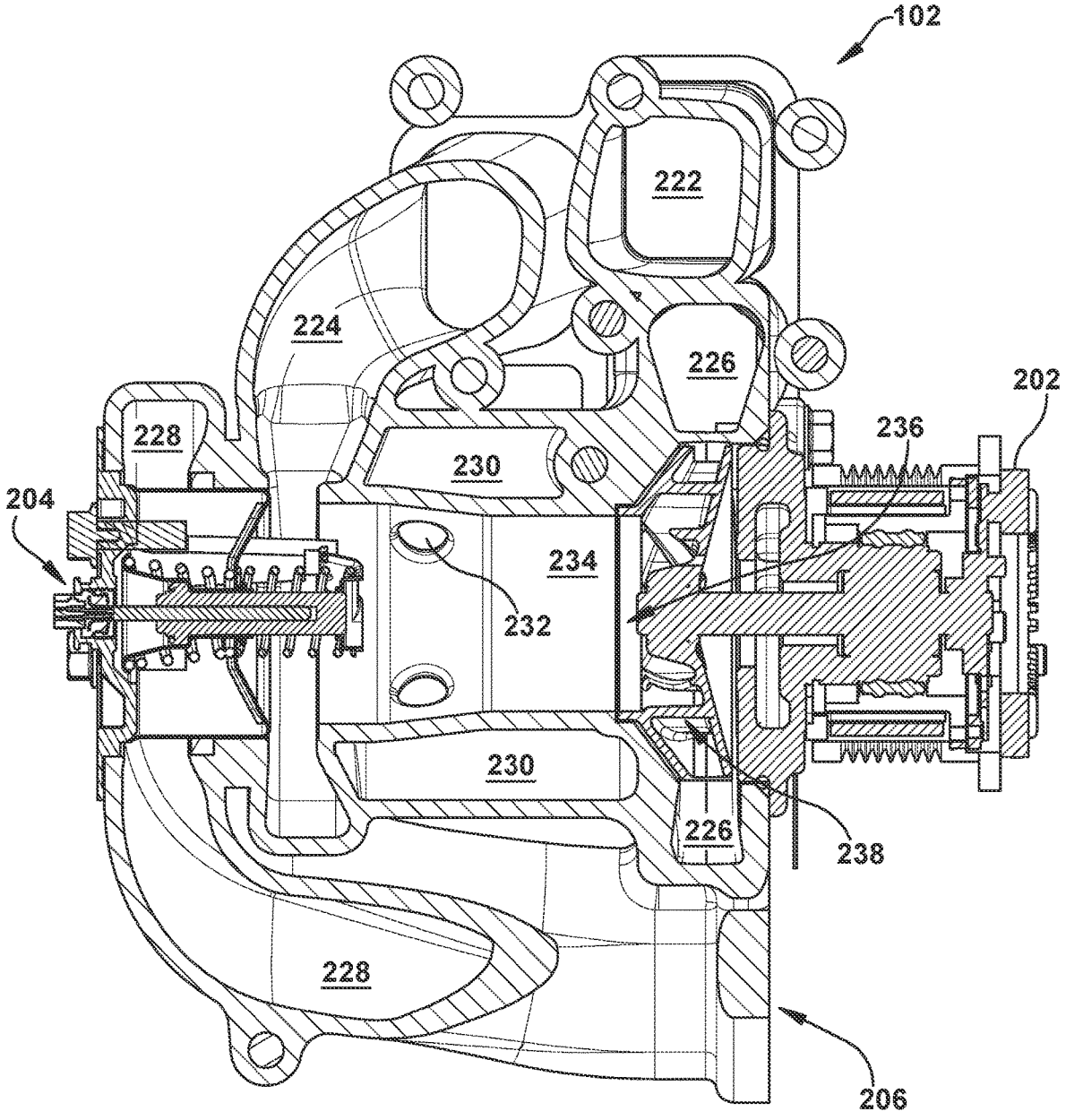
FIG. 8 illustrates a cross-sectional view of the coolant pump module.

Module 102 further includes a plurality of passages in fluid communication with the plurality of inlets and outlets described above. The passages are best seen in the cross-sectional view of FIG. 8. In FIG. 8, the cross-section is along an axis of module 102 as shown in FIGS. 6 and 7.

The plurality of passages include an EGR passage 222 that extends between EGR inlet 210 and EGR outlet 214. The EGR passage 222 is integrated with module 102, but is separate and isolated from other passages containing coolant flow. An bypass passage 224 is externally accessible (e.g. with respect to module 102) via the engine return inlet 216. The bypass passage 224, as described above, carries a coolant flow after circulation through the engine. The bypass passage 224 is in fluid communication with a pump inlet passage 234, which extends between thermostat 204 and pump 202.

A radiator passage 228 is externally accessible via the pump inlet 206 and carries a coolant flow after circulation through the radiator. The radiator passage 228 carries coolant to thermostat 204, which regulates the coolant flow from the radiator passage 228 to the pump inlet passage 234. For example, thermostat 204 may be configured according to a desired start-to-open temperature suitable for the engine and/or vehicle in which the module 102 is installed. In an aspect, the thermostat 204 reacts to a temperature of the fluid proximate to the exit of the bypass passage 224, where the coolant returning from the engine enters the pump inlet passage 234. When the fluid temperature reaches the start-to-open temperature, the thermostat 204 reacts by allowing coolant flow from the radiator passage 228 to the pump inlet passage 234, where it mixes with the coolant flow returning from the engine.

As described above, coolant returning from a surge tank may be received by module 102 via the surge tank port 208. The surge tank port 208 is in fluid communication with a mixing chamber 230. The mixing chamber 230 is also in fluid communication with the pump inlet passage 234 via one or more openings or apertures 232. Thus, the pump inlet passage 234 allows coolant returning from the engine, coolant returning from the surge tank, and coolant arriving from the radiator to mix prior to intake by pump 202. Accordingly, module 102 provides a more consistent coolant flow temperature to an engine and reduces a possibility of engine thermal shock.

As shown in FIG. 8, pump 202 includes a pump impeller inlet 236 positioned on one side of pump inlet passage 234 opposed from thermostat 204. A pump impeller outlet 238 is in fluid communication with a coolant output passage 226, which leads to module outlet 212 and, then, to the engine. In one example, coolant output passage 226 is a volute shape. In addition, the volute is integrated into module 102.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

The invention claimed is:

1. A coolant pump module for an engine, comprising:

a module housing having a set of integrated passages, the set of integrated passages include at least:

a first passage for fluid flow from a radiator;

a second passage for fluid flow from the engine;

a third passage for fluid flow to the engine; and a fourth passage for gas flow associated with an exhaust gas recirculation (EGR) system of the engine;

a thermostat coupled to the module housing in proximity to the first passage and the second passage; and a pump mounted to the module housing for moving a coolant through a cooling circuit of the engine.

2. The coolant pump module of claim 1, wherein the fourth passage includes an inlet and an outlet for gas flow, and wherein the fourth passage is separate and isolated from other passages of the set of integrated passages.

3. The coolant pump module of claim 1, wherein the set of integrated passages further comprises a pump inlet passage between the thermostat and an inlet of the pump.

4. The coolant pump module of claim 3, further comprising a port for return flow from a surge tank of the cooling circuit.

5. The coolant pump module of claim 4, further comprising a mixing chamber, wherein the mixing chamber is in fluid communication with the pump inlet passage via a set of apertures, and wherein return flow from the surge tank enters the mixing chamber via the port.

6. The coolant pump module of claim 1, wherein the first passage and the second passage include respective inlets and outlets, wherein the respective inlets couple to respective portions of the cooling circuit to receive fluid flow, and wherein the respective outlets deliver fluid to a location proximate to the thermostat to facilitate mixing of respective fluid flow via the first and second passages, through operation of the thermostat, upstream of the pump.

7. The coolant pump module of claim 6, wherein the thermostat is configured to operate in accordance with a predetermined temperature.

8. The coolant pump module of claim 7, wherein an outlet of the first passage is in fluid communication with an inlet of the pump via a pump inlet passage, and wherein the thermostat opens, when a fluid temperature at the outlet of the first passage exceeds the predetermined temperature, to allow flow to the pump from an outlet of the second passage via the internal.

9. The coolant pump module of claim 8, wherein the predetermined temperature is a start-to-open temperature of the thermostat, wherein the thermostat is configure to proportionately open to a greater extent based on how much the fluid temperature exceeds the start-to-open temperature, thereby allowing more flow via the second passage as the fluid temperature increases beyond the start-to-open temperature.

10. A method for controlling a coolant flow through a cooling circuit of an engine, comprising:

receiving a first and second coolant flow from the engine and a radiator, respectively, at a coolant pump module coupled to the cooling circuit;

combining the first and second coolant flows via operation of a thermostat integrated with the coolant pump module, wherein the thermostat is responsive to a temperature of the coolant at the coolant pump module;

receiving a return flow from a surge tank at the coolant pump module after the combining; and outputting a third coolant flow to engine via a pump integrated with the coolant pump module.

11. The method of claim 10, wherein the thermostat increases an amount of fluid from the second coolant flow combined with the first coolant flow as the temperature increases.

12. The method of claim 10, wherein the thermostat inhibits the second coolant flow until the temperature reaches a start-to-open temperature.

13. The method of claim 10, further comprising mixing the return flow with at least the first coolant flow upstream of the pump.

14. The method of claim 13, wherein the mixing occurs via a mixing chamber in fluid communication with a pump inlet passage via one or more apertures.

15. A module, comprising:

a monolithic unit providing a plurality of fluid passages, wherein the plurality of passages include at least a radiator intake passage, a bypass passage, a coolant output passage, an engine gas recirculation passage, and a pump inlet passage;

a pump coupled to the monolithic unit, wherein a pump inlet is in fluid communication with the pump inlet passage and a pump outlet is in fluid communication with the coolant output passage; and a thermostat coupled to the monolithic unit proximate to the radiator passage and the bypass passage, wherein the thermostat is configured to regulate a coolant flow into the coolant pump module from the radiator passage in accordance with a fluid temperature.

16. The coolant pump module of claim 15, wherein the bypass passage is in fluid communication with the pump inlet passage and the radiator passage is in fluid communication with the pump inlet passage when the thermostat is open.

17. The coolant pump module of claim 16, wherein a flow from the radiator passage and a flow from the bypass passage mixes in the pump inlet passage in proximity to the thermostat.

18. The coolant pump module of claim 15, wherein the monolithic unit further comprises a surge tank return port in fluid communication with a mixing chamber, the mixing chamber is also in fluid communication with the pump inlet passage via one or more openings.

19. The coolant pump module of claim 15, wherein the exhaust gas recirculation passage is separate and isolated from other passages of the plurality of passages.

* * * * *